US007900573B2

(12) United States Patent
Prendergast et al.

(10) Patent No.: US 7,900,573 B2
(45) Date of Patent: Mar. 8, 2011

(54) SUBMARINE ESCAPE SUIT

(75) Inventors: Robert Prendergast, Bootle (GB); Stephen Littler, Morton (GB)

(73) Assignee: Survitec Group Limited, Birkenhead (GB)

( * ) Notice: Subject to any disclaimer, the term of this patent is extended or adjusted under 35 U.S.C. 154(b) by 0 days.

(21) Appl. No.: 12/302,433

(22) PCT Filed: May 25, 2007

(86) PCT No.: PCT/GB2007/001948

§ 371 (c)(1),
(2), (4) Date: Feb. 5, 2009

(87) PCT Pub. No.: WO2007/138281

PCT Pub. Date: Dec. 6, 2007

(65) Prior Publication Data

US 2009/0139440 A1 Jun. 4, 2009

(30) Foreign Application Priority Data

May 31, 2006 (GB) ..... 0610779.1

(51) Int. Cl.
*B63G 8/40* (2006.01)

(52) U.S. Cl. ..... 114/336; 441/105

(58) Field of Classification Search ..... 114/311, 114/336; 405/185, 186; 441/90, 92, 102, 441/103, 104, 107, 105, 88
See application file for complete search history.

(56) References Cited

U.S. PATENT DOCUMENTS

| | | | | |
|---|---|---|---|---|
| 1,878,434 | A * | 9/1932 | Belloni | 441/105 |
| 3,902,327 | A * | 9/1975 | Guillerm et al. | 405/186 |
| 3,969,903 | A * | 7/1976 | Boisrayon et al. | 405/186 |
| 5,127,896 | A * | 7/1992 | de Gaston | 600/20 |
| 6,860,775 | B2 * | 3/2005 | Buzzetti | 441/88 |
| 6,976,894 | B1 * | 12/2005 | Turner | 441/102 |
| 2004/0237178 | A1 * | 12/2004 | Landeros | 2/457 |

FOREIGN PATENT DOCUMENTS

| | | |
|---|---|---|
| EP | 0 444 400 | 9/1991 |
| GB | 1 484 748 | 9/1977 |
| GB | 2 330 517 | 4/1999 |
| JP | 58 188786 | 11/1983 |

* cited by examiner

*Primary Examiner* — Lars A Olson
(74) *Attorney, Agent, or Firm* — Workman Nydegger

(57) ABSTRACT

A submarine escape suit includes an ascent stole (22) for assisting a wearer to ascent to the surface from a submarine. The suit also includes a life preserver stole (26) that can be inflated on reaching the surface, to provide the suit with additional surface buoyancy. The life preserver stole (26) can also be inflated underwater to provide the suit with additional ascent buoyancy, if required.

14 Claims, 2 Drawing Sheets

SUBMARINE ESCAPE SUIT

The invention relates to submarine escape suits.

The submarine escape suit is used to escape from a submarine in an emergency. The suit is donned by a wearer within the submarine and the wearer then moves to an escape tower in the submarine where an inflatable chamber of the suit is connected to a supply of inflation gas, such as a supply provided in the submarine, to inflate the inflatable chamber and an ascent hood via relief valves. At the same time, the escape tower fills with water and an outer hatch opens to allow the buoyancy provided by the inflatable chamber and the hood to raise the wearer to the surface. A suit of this general type is shown in EP-A-0444400.

The buoyancy provided by the inflatable chamber and the hood must be carefully chosen to provide the correct speed of ascent of the wearer-neither too quickly nor too slowly. It is a problem that the chamber volume required for this purpose is often insufficient to support the wearer satisfactorily once the wearer reaches the surface.

According to a first aspect of the invention, there is provided a submarine escape suit comprising an ascent hood, a first inflatable chamber, an inflation tube leading to the first inflatable chamber and for connection to a supply of breathable gas to provide ascent buoyancy for the suit and breathable gas to the ascent hood, a second inflatable chamber and a gas supply carried by the suit and operable to inflate the second chamber to provide the suit with additional buoyancy.

According to a second aspect of the invention, there is provided a method of operating a submarine escape suit according to the first aspect of the invention, comprising inflating said first chamber under water using said inflation tube to provide ascent buoyancy and breathable gas to the ascent hood, ascending to the surface of the water and actuating the air supply to inflate the second chamber to provide the suit with additional buoyancy.

It can also be a problem that the first inflation chamber could become deflated due to damage or failure and provide insufficient buoyancy during ascent.

According to a third aspect of the invention, there is provided a method of operating a submarine escape suit according to the first aspect of the invention comprising inflating said first chamber under water using said inflation tube to provide ascent buoyancy and breathable gas to the ascent hood, ascending towards the surface of the water and, before reaching the surface of the water, actuating the air supply to inflate the second chamber to provide the suit with additional buoyancy.

In this way, additional buoyancy can be provided when the buoyancy of the first chamber is insufficient.

Figure 1:
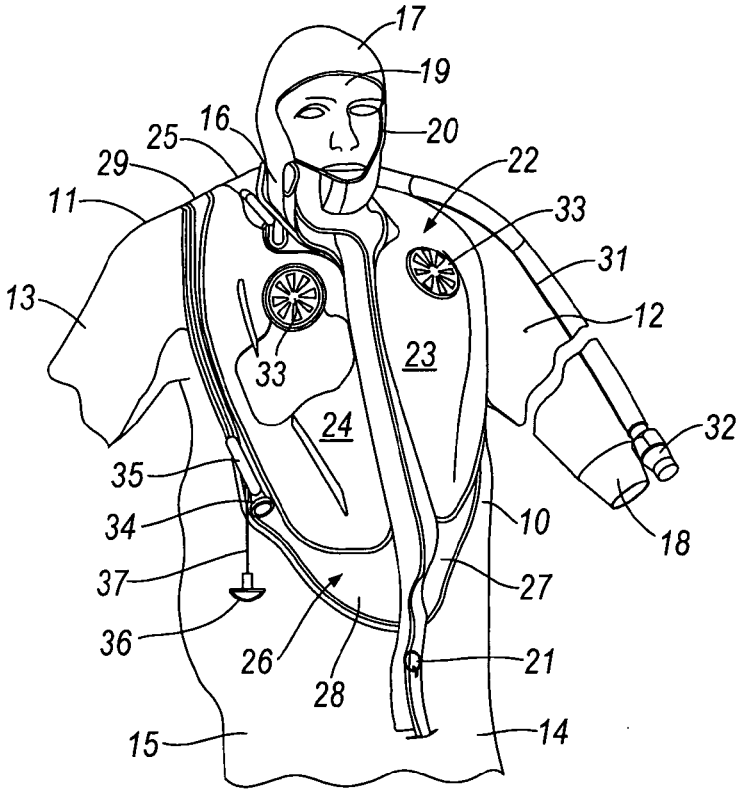
Figure 2:
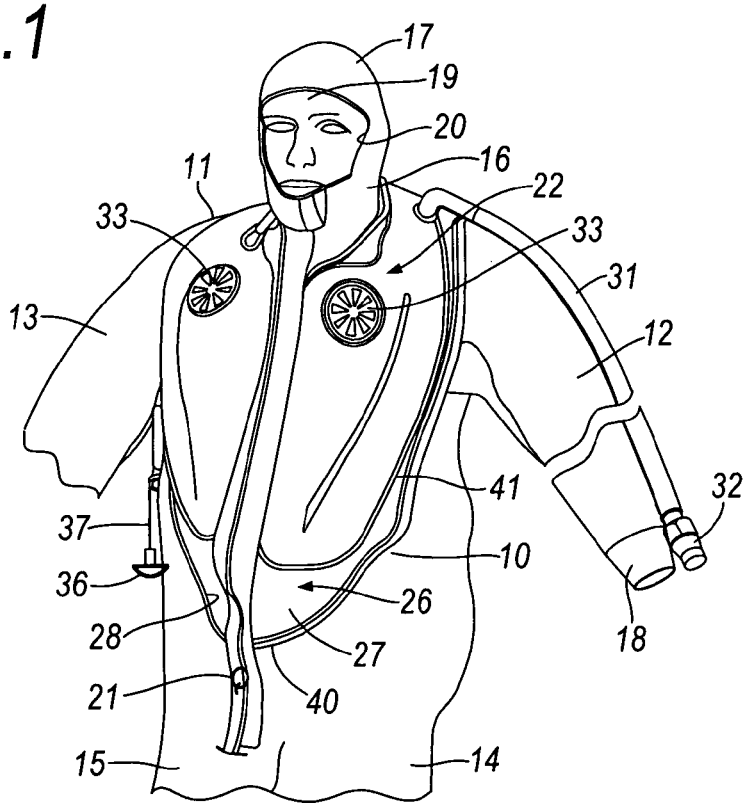
Figure 3:
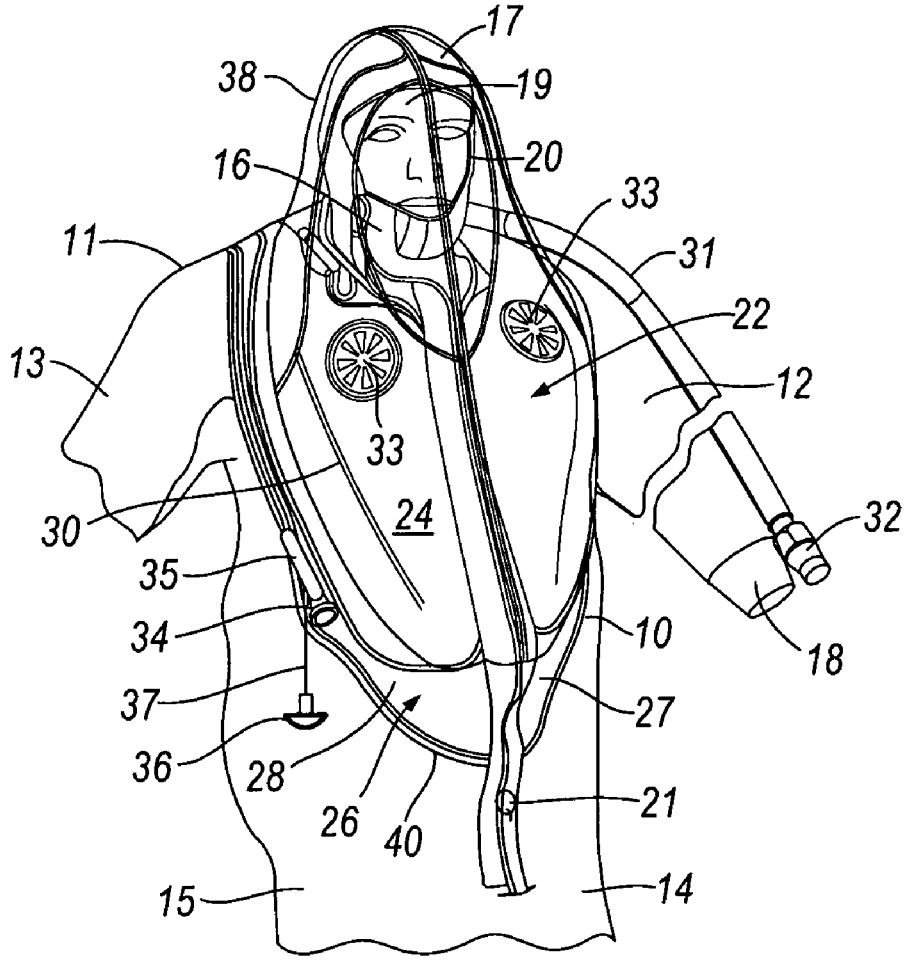
Figure 4:
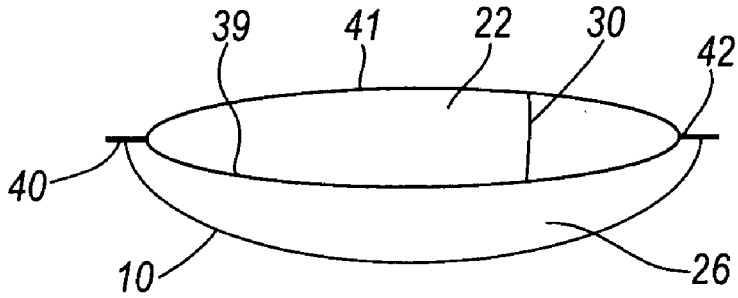

The following is a more detailed description of an embodiment of the invention, by way of example, reference being made to the accompanying drawings in which:

FIG. 1 is a partial view of the front and to one side of a submarine escape suit with an ascent hood omitted, with first and second inflatable chambers and with the first chamber partly cut away, FIG. 2 is a similar view to FIG. 1 but from the front and to the other side, FIG. 3 is a similar view to FIG. 1 but with an ascent hood, and FIG. 4 is a section on the line X-X of FIG. 2.

Referring to the drawings, the submarine escape suit is a garment with a front panel 10, a rear panel 11, a left arm 12, a right arm 13, a left leg 14, a right leg 15, a neck portion 16 and a head portion 17. The left arm 12 and the right arm 13 terminate in respective cuffs, one of which is shown at 18 in FIGS. 1, 2 and 3. The left leg 14 and the right leg 15 terminate in respective foot covers (not shown). The head portion 17 is intended to cover the head of the wearer 19 and includes a face aperture 20. The suit is made from portions of weldable material such as polyurethane (PU) coated fabric. Access to the suit is via an elongate zip 21 extending from the neck portion 16 down the centre of the front panel 10.

The suit includes an ascent stole 22 in the form of an elongate inflatable chamber having first and second ends 23, 24 extending over the front panel 10 and an interconnecting central portion 25 extending over the rear panel 11 around the neck portion 16. The ascent stole 22 overlies a life preserver stole 26. The life preserver stole 26 is formed by an elongate inflatable chamber with a first end 27 and a second end 28 overlying the front panel 10. The first and second ends 27, 28 are interconnected by a central portion 29 extending over the rear panel 11 and around the neck portion 16.

The ascent stole 22 and the life preserver stole 26 are formed as follows.

First, a first generally U-shaped sheet of weldable material 39, such as a PU coated fabric, is placed around the neck portion 16 of the suit and over the front panel 10. This portion, seen in FIG. 4, is then welded around its periphery along a weld line 40 to the front panel 10 and the rear panel 11. This forms the life preserver stole 26. A second U-shaped sheet of weldable material 41 such as a PU coated fabric 41 is then laid over the first piece of material and welded around its edges to the first piece along a weld line 42 inwardly of the weld line 40 for the first material 39. This forms the ascent stole 22. As seen in FIG. 4, the ascent stole 22 includes two internal reeds 30 of material interconnecting the second sheet 41 and the first sheet 39, to limit the expansion/volume of the chamber when inflated. There may be one such reed 30 or three or more such reeds 30.

The ascent stole 22 is provided with an inflation tube 31 that leads from the ascent stole 22 along the left arm 12 to terminate in a connector 32 at the left cuff 18. The connector 32 is for connection to a supply of breathable air which may, for example, be in a submarine. In some applications, the ascent stole (22) is inflated from an independent bottle supply (not shown) mounted in a pocket on the suit. The ascent stole 22 also includes two relief valves 33. The function of these will be described below.

The life preserver stole 26 is connected to an air supply formed by a valve 34 and source of gas under pressure 35. The valve 34 is operated by pulling on a toggle 36 connected to a cord 37.

The suit is completed by an ascent hood 38 seen in FIG. 3. The ascent hood 38 is a fabric member that incorporates a clear plastic visor and covers the head of a wearer and has its periphery generally engaging around the outer periphery of the ascent stole 22 so that the ascent hood covers the relief valves 33.

It will be appreciated that the submarine escape suit shown in the drawings may also include other items such as a liferaft (not shown) with its own inflation system contained in a pocket on the front or to one side of the suit and connected to the suit by a cord.

In use, the suit is held in a packed condition in a submarine. In an emergency or for training, the suit is unpacked, the zip 21 opened and the suit donned by a wearer. This is as shown in FIGS. 1, 2 and 3.

The wearer then moves into an escape tower of a submarine. Once in the escape tower, the wearer connects the connector 32 to a supply of breathable gas, such as an air supply provided in the submarine, via an outlet in the escape tower. The breathable gas inflates the ascent stole 22 and passes through the relief valves 33 into the ascent hood 38 to provide a supply of breathable gas for the wearer. At the same time, the escape tower fills with water and, once filled, an exit opens.

The natural buoyancy of the wearer, together with a calculated buoyancy of the ascent chamber and the hood 38 causes the wearer to leave the chamber and ascend towards the surface at a controlled rate determined at least partially by the volume of the ascent stole 22 and the hood 38. As the pressure in the ascent stole 22 increases, air is relieved by the relief valves 33 into the hood 38 where it can be used for breathing by the wearer.

Once the wearer reaches the surface, the wearer can pull the toggle 36 and the cord 37 to actuate the valve 34 to connect the source of gas 35 to the life preserver stole 26. The effect of this is to inflate the life preserver stole 26. This provides the suit and wearer with additional buoyancy, which may be sufficient to turn the wearer onto the wearer's back if the wearer is initially face down in the water. The volume of air in the ascent stole 22 required to ensure correct ascent may in many cases be insufficient to achieve this. In addition, the increased volume provided by the life preserver stole 26 ensures that the wearer is better supported on the surface than would be the case with the ascent stole only. The inflated volume of the life preserver stole 26 may be greater than the inflated volume of the ascent stole 22.

In an alternative mode of operation, the life preserver stole 26 can be used in the event that the ascent stole 22 fails or provides insufficient buoyancy during ascent. In this case, the wearer can operate the valve 34 via the toggle 36 during ascent to inflate the life preserver stole 26 to provide additional buoyancy to the suit and thus faster ascent.

It will be appreciated that there are a number of alterations that can be made to the arrangement described above with reference to the drawings. Although the ascent stole 22 and the life preserver stole 26 are shown as overlying one another, this need not be the case; they could be laterally spaced from one another. In addition, although the ascent stole 22 and the life preserver stole 26 are shown as having a generally U-shaped configuration extending over the front panel 10 and around the neck portion 16 and the rear panel 11, they could be of any convenient shape.

Although the air supply for the life preserver stole 26 is shown as being manually operable, additionally or alternatively, it could be operated automatically in the event that the wearer in unconscious when reaching the surface to ensure that the wearer is always turned onto the wearers back.

The life preserver stole 26 is shown formed by a single chamber; it could be formed by two or more chambers fed by a single air supply or by individual air supplies.

The invention claimed is:

1. A submarine escape suit comprising:

an ascent hood;

a first inflatable chamber;

an inflation tube extending from the first inflatable chamber along an arm of the suit and terminating in a connector at a cuff of the arm for connection to a supply of breathable gas in a submarine to provide ascent buoyancy for the suit and breathable gas to the ascent hood;

a second inflatable chamber; and a gas supply carried by the suit and operable to inflate the second inflatable chamber to provide the suit with additional buoyancy.

2. A suit according to claim 1 wherein the first chamber is elongate with first and second end portions extending over a front panel of the suit and a central portion extending around a neck and over a rear panel of the suit.

3. A suit according to claim 1 wherein the second chamber is elongate with first and second end portions extending over a front panel of the suit and a central portion extending around a neck and over a rear panel of the suit.

4. A suit according to claim 3 wherein the first chamber is elongate with first and second end portions extending over a front panel of the suit and a central portion extending around a neck and over a near panel of the suit and wherein the first chamber overlies the second chamber.

5. A suit according to claim 4 wherein the second chamber is formed between surface portions of the front and rear panels and a first sheet of material overlying the front and rear panels, and the first chamber is formed between the first sheet of material and a second sheet of material overlying the first sheet of material.

6. A suit according to claim 1 wherein the second chamber, when inflated, has a greater volume than the first chamber.

7. A suit according to claim 1 wherein the second chamber, when inflated, provides a self-righting function for a wearer immersed face-down in water.

8. A suit according to claim 1 wherein the gas supply is manually operable.

9. A suit according to claim 8 wherein the gas supply includes a source of gas under pressure connected to the second chamber by a valve operated manually.

10. A suit according to claim 1 wherein the inflation tube extends from the first chamber along an arm of the suit and terminates in a connector at a cuff of the arm, the connector being connected to a breathable gas supply included in the suit.

11. A method of operating a submarine escape suit according to claim 1 comprising inflating said first chamber under water using said inflation tube to provide ascent buoyancy and breathable gas to the ascent hood ascending to the surface of the water and then actuating the air supply to inflate the second chamber to provide the suit with additional buoyancy.

12. A method of operating a submarine escape suit according to claim 1 comprising inflating said first chamber under water using said inflation tube to provide ascent buoyancy and breathable gas to the ascent hood, ascending towards the surface of the water, and, before reaching the surface of the water, actuating the air supply to inflate the second chamber to provide the suit with additional buoyancy.

13. A submarine escape suit comprising:

an ascent hood;

a first inflatable chamber;

an inflation tube leading to the first inflatable chamber and for connection to a supply of breathable gas to provide ascent buoyancy for the suit and breathable gas to the ascent hood;

a second inflatable chamber; and a gas supply carried by the suit and operable to inflate the second chamber to provide the suit with additional buoyancy, wherein the first inflatable chamber is elongate with first and second end portions extending over a front panel of the suit and a central portion extending around a neck and over a near panel of the suit, the first chamber overlying the second inflatable chamber.

14. A submarine escape suit comprising:

an ascent hood;

a first inflatable chamber;

an inflation tube leading to the first inflatable chamber and for connection to a supply of breathable gas to provide ascent buoyancy for the suit and breathable gas to the ascent hood;

a second inflatable chamber; and a gas supply carried by the suit and operable to inflate the second inflatable chamber to provide the suit with additional buoyancy, the second inflatable chamber, when inflated, providing a self-righting function for a wearer immersed face-down in water.

* * * * *